United States Patent [19]

Kranz

[11] Patent Number: 5,016,835

[45] Date of Patent: May 21, 1991

[54] GUIDED MISSILE

[75] Inventor: Walter Kranz, Taufkirchen, Fed. Rep. of Germany

[73] Assignee: Messerschmitt-Bölkow-Blohm GmbH, München, Fed. Rep. of Germany

[21] Appl. No.: 444,819

[22] Filed: Dec. 1, 1989

[30] Foreign Application Priority Data

Jan. 14, 1989 [DE] Fed. Rep. of Germany ..... 3901041

[51] Int. Cl.[5] ..... F42B 15/033

[52] U.S. Cl. ..... 244/3.22; 239/265.19; 60/230

[58] Field of Search ..... 244/3.22; 239/265.29, 239/263.31, 265.19; 60/230, 228

[56] References Cited

U.S. PATENT DOCUMENTS 3,599,899 8/1971 McCullough ..... 244/3.22

4,807,529 2/1989 Frazer ..... 244/3.22

*Primary Examiner*—Deborah L. Kyle

*Assistant Examiner*—J. Woodrow Eldred

*Attorney, Agent, or Firm*—Kenyon & Kenyon

[57] ABSTRACT

A guided missile with a hot-gas generator, whose gas penetrates a plurality of blow-out nozzles, which are arranged at regular intervals along the circumference and extend essentially perpendicularly to the longitudinal missile axis, whereby the flow rate of the gas through the individual blow-out nozzles can be regulated by a control device. The control device has a star coupling, which contains a number of arms corresponding to the number of blow-out nozzles, whereby each arm has a positioning element assigned to it, the corresponding blow-out nozzle can close completely or partially, and each arm has a control element assigned to it.

12 Claims, 3 Drawing Sheets

GUIDED MISSILE

BACKGROUND OF THE INVENTION

The present invention relates to a guided missile with a hot-gas generator, whose gas penetrates a plurality of blow-out nozzles, which are arranged at regular intervals along the circumference and extend essentially perpendicularly to the longitudinal missile axis, whereby the flow rate of the gas through the individual blow-out nozzles can be regulated by a control device.

If the gas generated by the incorporated hot-gas generator is alternately blown out through one or several of the jet nozzles arranged more or less perpendicularly to the longitudinal missile axis in the area of its forward tip, then initially a transverse force develops. This transverse force is derived from the absolute thrust of the generated gas. A second transverse force develops as well, when the oncoming flow dams up as the gas emerges from the nozzle (secondary injection effect or fluid-dynamic effect). This causes the first transverse force to be strengthened. This strengthening depends on several influences such as speed, the distance between the nozzle and the tip of the missile, and the mass rate of flow through the nozzle.

In this manner, the fuel carried by the missile is better utilized, for example, when a high rate of transverse acceleration is required in the final phase of the flight. Shortly after starting and with a minimal mass rate of flow through the nozzle, a large transverse force is attained as a result of the fluid-dynamic strengthening effect. The strengthening more or less equals twice or two-and-a-half times the absolute transverse force. In the final phase of the flight, with considerably reduced speed and without a great deal of transverse-force strengthening, the mass rate of flow, which is stepped up as a result of the burn-off from the hot-gas generator, in other words, the stepped-up, absolute transverse force of the emerging gases, acts alone.

SUMMARY OF THE INVENTION

An object of the present invention is to simplify the device which controls the rate of gas flow through the blow-out nozzles and to improve its effectiveness.

The above and other objects of the invention are achieved by a guided missile with a hot-gas generator, gas from the generator penetrating a plurality of blow-out nozzles arranged at regular intervals along a circumference of the missile and extending essentially perpendicularly to the longitudinal missile axis, whereby the flow rate of the gas through the individual blow-out nozzles can be regulated by a control device, the control device having a star coupling, comprising a number of arms corresponding to the number of blow-out nozzles, each arm having a positioning element assigned to it, the corresponding blow-out nozzle being closable completely or partially, each arm having a control element assigned to it.

The positioning or adjusting element can be a piston, which is movable in the axial direction and is disposed parallel to the outer wall of the guided missile. The positioning or adjusting element can be a ball valve as well.

The control element can be an electromagnet either with a pull rod, which grasps the star coupling and engages with the electromagnets, or with an anchor plate, which has a control wire attached to it, whereby the other end of this control wire contacts one arm of the star coupling.

The star coupling itself is advantageously disposed perpendicularly to the longitudinal axis of the guided missile and has two, three or more than three arms.

It is advantageously supported in the center either on a pivot or on a hemisphere.

Compared to the transverse forces in missiles with rudder systems, one attains the advantage with the guided missile according to the invention that its generated transverse forces are less dependent on the speed of the missile. This is accomplished without a pressure controller (as a critical component) and by using better load-equalized control elements with good stationary and dynamic performance.

BRIEF DESCRIPTION OF THE DRAWINGS

In the following, the invention is described in greater detail based on the drawings, which depict a few advantageous exemplified embodiments, wherein.

DETAILED DESCRIPTION

Figure 1:
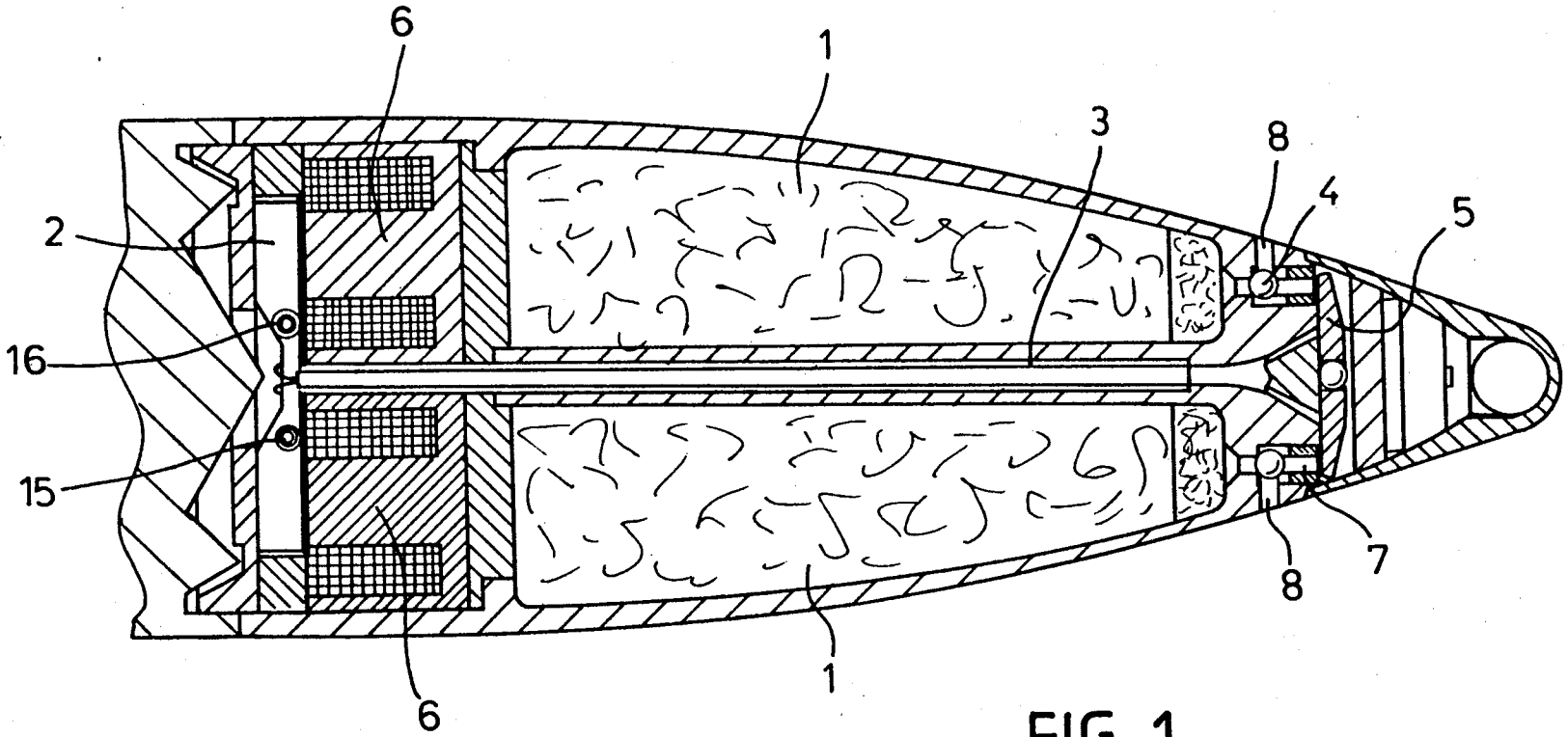
FIG. 1 shows a partial section through a first exemplified embodiment of a guided missile according to the invention.

FIG. 1 shows a partial section through the nosepiece of a guided missile of, for example, 35 mm caliber. In the area of the nose of the projectile, it is provided with a plurality of blow-out ports 8 arranged along its circumference, whose axes extend essentially perpendicularly to the longitudinal axis of the missile. These blow-out ports 8 are connected to a hot-gas generator 1, via suitable channels. Ball valves 4 are mounted in these channels at an appropriate point and are movable by means of valve tappets 7, so that the rate of flow of the gas through these blow-out ports can be adjusted by a suitable control device.

In the case of the exemplified embodiment depicted in FIG. 1, the control device has a star coupling 5, which is supported in the center so that it can tilt on a pivot consisting of a hemisphere or of a solid sphere The star coupling has as many arms as there are blow-out nozzles. Each of the arms of the star coupling 5 has a valve tappet 7 assigned to it, which in turn is provided with a ball valve 8, so that by tilting the star coupling 5, the rate of flow of the gas through the blow-out nozzles can be altered. In this case, the star coupling 5 is controlled by control wires 3, which are arranged parallel to the longitudinal axis of the guided missile and are actuated via magnets 6, which are mounted on the side of the hot-gas generator 1 which is turned away from the star coupling.

In the case of the exemplified embodiment depicted in FIG. 1, three blow-out nozzles 8 and three magnets 6 are provided with control wires 3 for the three-armed star coupling 5. As long as none of the magnets is actuated, the same amount of gas flows out of all the nozzles, whereby the forces generated to the outside cancel each other out. This means that the three existing magnets 6 are not excited. Conditioned by the gas forces, which act on the three ball valves 4 and consequently on the valve tappets 7 and the star coupling 5, the control wires 3 are tensioned, whereby these wires are fixed on the limit stops 15 of the anchor plates 2. The anchor plates 2 themselves can swivel around the pivots 16.

Now, if one of the blow-out nozzles is to generate a transverse force, then the magnets of the other two blow-out nozzles are simultaneously excited. The two corresponding control wires pull on the star coupling, so that by actuating the corresponding valve tappets and ball valves, these two blow-out nozzles are sealed off. At the same time, the blow-out nozzle opens, which is supposed to generate the transverse force, beyond the original measure, conditioned by the position of the pivot, which is situated between this nozzle and the actuated control wires, against a corresponding tilting of the star coupling.

When the magnets are in a non-excited state, the gas forces or the occurring momenta press the star coupling back into the three supporting points formed by the three ends of the control wire.

The three blow-out nozzles can be actuated one after the other, each after the guided missile rotates 120°, whereby the operation is performed by disconnecting that magnet, whose blow-out nozzle should produce the thrust.

Figure 2:
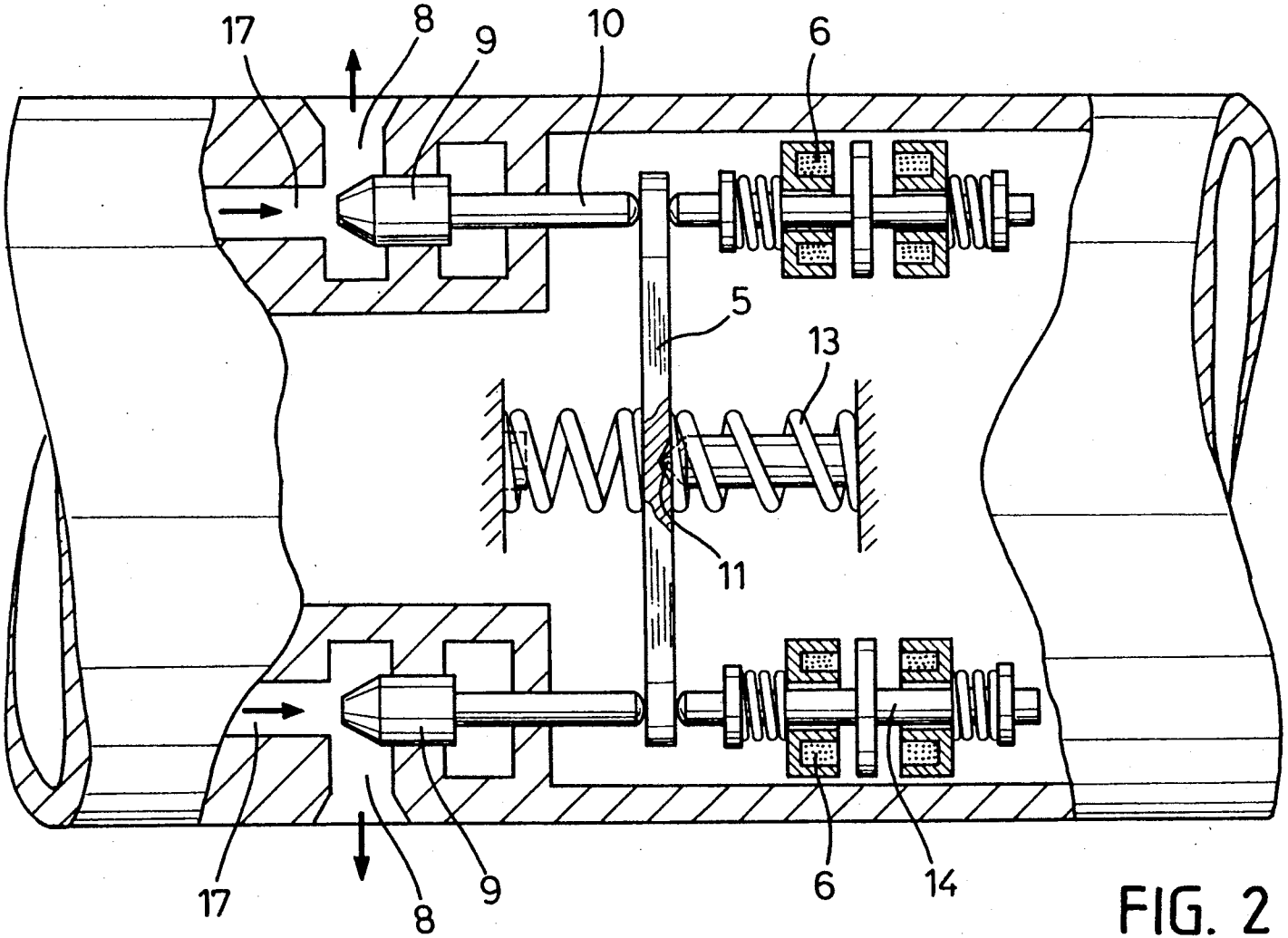
FIG. 2 shows an enlarged partial section through a second exemplified embodiment of a guided missile according to the invention.

FIG. 2 illustrates a second exemplified embodiment of a guided missile according to the invention, whereby in this case two channels are designated with 17. They lead to the hot-gas generator and are connected with the blow-out nozzles 8, whose longitudinal axis extends perpendicularly to the longitudinal axis of the missile. Pistons 9 project into the blow-out nozzles 8. These pistons are coupled to a connecting rod 10, which can be actuated by the star coupling 5. In the exemplified embodiment shown here, the star coupling 5 has two arms, which are coupled to two connecting rods !0 for two pistons 9, whereby the guided missile itself is provided with two blow-out nozzles 8. In this case, the star coupling 5 is supported so that, at the center, it can tilt on a pivot 11 and is loaded by the force of a spring 13.

Two electromagnets are designated with 6. A rod 14 engages into each of these electromagnets. When the electromagnets are excited, this rod is shifted axially and thus allows the star coupling 5 to tilt around its bearing 11. According to the tilting direction, one of the two pistons 9 screws into one of the blow-out nozzles 8 and more or less seals it off.

Figure 4:
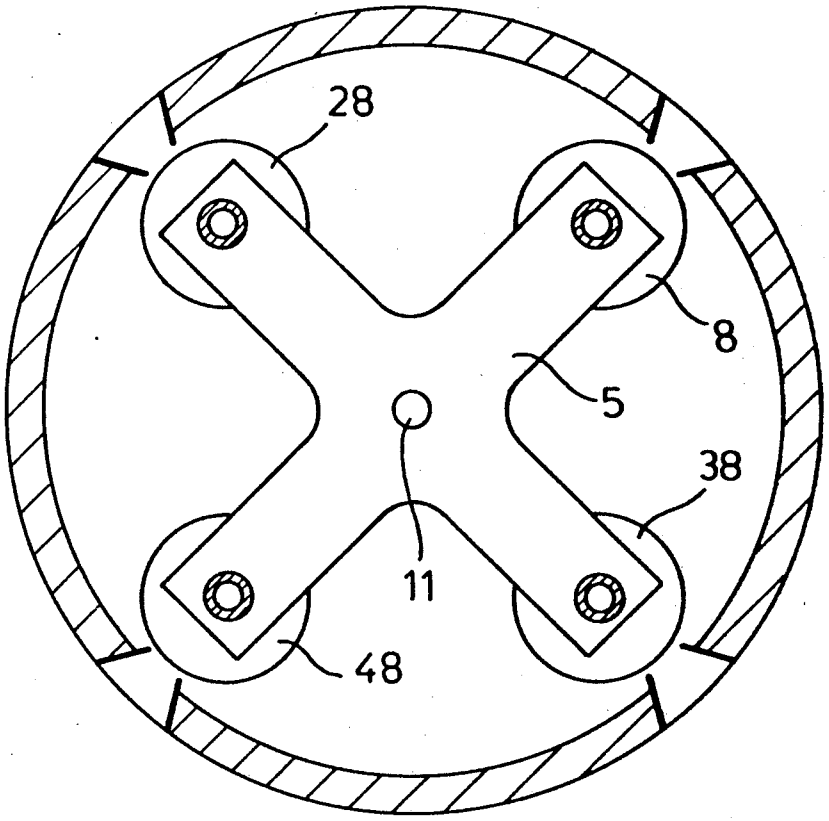
FIGS. 3 and 4 show two top views of two different star couplings.
Figure 3:
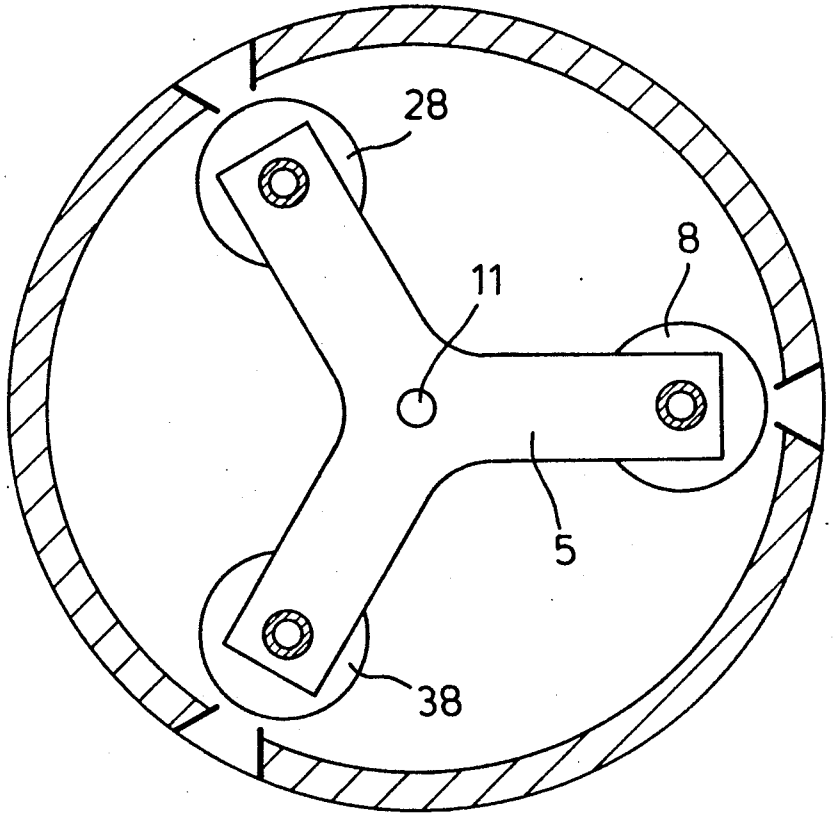

FIG. 3 shows a top view of a coupling star 5 with three arms for controlling a guided missile with three blow-out nozzles, and FIG. 4 depicts a top view of a star coupling with four arms arranged in a cross shape to control a guided missile with four blow-out nozzles.

Since the blow-out nozzles close to the forward tip of the guided missile are preferably arranged with a clearance of approximately 20 mm, the result is that the hot-gas generator as well as the magnet system must lie on one side, viewed from the blow-out nozzles. This means that either a direct connection is attained between the blow-out nozzles and the magnetic control system, whereby the hot gas passes through the magnetic system to the nozzles, or else a direct connection is attained between the hot-gas generator and the blow-out nozzles, and the control signals pass through, that is they are mechanically transmitted from the magnetic system through the hot-gas generator or past the hot-gas generator.

In the case of the latter specific embodiment, as shown schematically in the exemplified embodiment according to FIG. 1, one obtains the largest possible transverse force across the angle of incidence of the guided missile, that is the greatest possible utilization of the fuel carried by the missile in the hot-gas generator. For example, if a full firing command is given, as the guided missile is rolling around its longitudinal axis, for example, to blow out the greatest possible amount of constantly burning fuel as thrust in the defined spatial transverse direction, the result is that the fuel will be utilized all the more efficiently, the more blow-out nozzles there are situated along the circumference of the guided missile. In this case, one of the nozzles, namely the one situated at the time in the commanded spatial direction, is activated, that is it contains the hot gas.

It is essentially advantageous, when three nozzles are provided at the tip of the guided missile and with full caliber, that the corresponding three electromagnets are accommodated with the greatest possible availability of space. The three nozzles then generate an average effectiveness of approximately 85% of the carried propellant charge, which acts across the thrust in a defined spatial direction.

The star coupling according to the invention is a connecting link between the positioning or adjusting element, which consists of the blow-out nozzles and the corresponding sealing parts and the control element, which in the simplest case consists of several double magnetic systems featuring elastic suspension in the central position. The purpose of the star coupling is to control the flight of guided missiles (or other missiles) by using several blow-out nozzles, whereby in the idle position of the adjusting piston, that is in its middle position, as well as in the end positions (and the positions lying in between), there is a constant effluence of hot gas over the entirety of the blow-out nozzle. This means that the hot-gas generator has a problem-free design and does not require any additional pressure regulation.

The control elements themselves are relieved to a great extent, as far as their actuating energy is concerned, by the prevailing pressure exerted by the hot-gas generator on the opposite sealing parts. This increases the range of the permissible gas generator pressure, which fluctuates with the outside temperature. A constant effluence of hot gas is ensured, in spite of different switching times, for example, when the affected magnets are switched over. Virtually all methods for activating the control elements apply here; for example, a continuous actuation of the two-step or three-step operation, pulse-length modulation, and selective overlapping of the signals on the control elements.

It is significant in this case that the position and the movement of the positioning or adjusting elements in the axial direction is exclusively or chiefly defined by the movement and the position of the star coupling and not by the position and the movement of the individual control elements. The exemplified embodiment featuring a star coupling with three arms and a guided missile with three blow-out nozzles has proven optimal due to the hot gas yield of approximately 85%. When the star coupling according to the invention is not used, the guided missile with three blow-out nozzles utilizes approximately 85% of the hot gas as well, however, it does not have the above-mentioned advantages. A guided missile with four blow-out nozzles and a four-armed star coupling uses only approximately 70% of the hot gas, whereas a guided missile with four blow-out nozzles, but without a star coupling only utilizes approximately 93%, however, without the advantages of the star coupling, and with one more control element than the three-armed star coupling solution.

In the following, a comparison is made of the maximum hot gas yield [output]=thrust yield [efficiency], which can be attained, on the one hand, with a guided missile which has three blow-out nozzles and, on the other hand, with a guided missile which has four blow-out nozzles and a four-armed star coupling (according to FIGS. 3 and 4).

In the case of the exemplified embodiment shown in FIG. 3, one obtains the maximum thrust yield [efficiency] of 85% in one spatial direction, when one of the three blow-out nozzles 8, 28, 38 is the only one open, and the other two are closed. A thrust yield [efficiency] is obtained at the level of 43%, when the blow-out nozzles 8 and 28, or 28 and 38, or 38 and 8 are open at the same time, and the remaining blow-out nozzle is closed.

In the case of the exemplified embodiment depicted in FIG. 4, one obtains a maximum thrust yield [efficiency] of 70% in one spatial direction, when the blow-out nozzles 8 and 28, or 38 and 48, or 28 and 48, or 28 and 8 are open, and the remaining blow-out nozzles are closed.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. A guided missile having a hot gas generator for providing a gas penetrating a plurality of blow-out nozzles arranged at regular intervals along a circumference of the missile and extending substantially perpendicularly to a longitudinal missile axis, the gas having a flow rate, the flow rate of the gas being regulated through the individual ones of the blow-out nozzles by a control device, the control device having a star coupling comprising a plurality of arms corresponding to the number of blow-out nozzles, each arm having a positioning element disposed in proximity to the respective blow-out nozzle, the respective blow-out nozzle associated with the positioning element being closable by said positioning element such that said positioning element can at least partially close the respective blow-out nozzle, and further comprising a control element coupled to each positioning element for controlling the position of said positioning element.

2. The guided missile recited in claim 1, wherein each positioning element comprises a piston moveable in the axial direction and being disposed parallel to an outer wall of the guided missile.

3. The guided missile recited in claim 1, wherein each positioning element comprises a ball valve.

4. The guided missile recited in claim 1, wherein each control element comprises an electromagnet coupled to a pull rod, the pull rod engaging the star coupling and the electromagnet.

5. The guided missile recited in claim 1, wherein each control element comprises an electromagnet having an anchor plate, the anchor plate having one end of a control wire attached thereto, the other end of said control wire contacting one arm of the star coupling.

6. The guided missile recited in claim 1, wherein the star coupling has an extent perpendicular to the longitudinal axis of the guided missile.

7. The guided missile recited in claim 1, wherein the star coupling has two arms.

8. The guided missile recited in claim 1, wherein the star coupling has three arms.

9. The guided missile recited in claim 1, wherein the star coupling has more than three arms.

10. The guided missile recited in claim 1, wherein the star coupling is supported in its center on a pivot.

11. The guided missile recited in claim 1, wherein the star coupling has a center and is supported at the center on a hemisphere.

12. The guided missile recited in claim 1, wherein the star coupling has a center and is supported at the center on a solid sphere.

* * * * *

UNITED STATES PATENT AND TRADEMARK OFFICE

CERTIFICATE OF CORRECTION

PATENT NO. 5,016,835

DATED May 21, 1991

INVENTOR(S) Walter Kranz

It is certified that error appears in the above-identified patent and that said Letters Patent is hereby corrected as shown below:

In Column 3, line 34, change "...two connecting rods !0"
to read "...two connecting rods 10--

Signed and Sealed this

First Day of December, 1992

*Attest:*

DOUGLAS B. COMER

*Attesting Officer*

*Acting Commissioner of Patents and Trademarks*